US010161583B1

(12) United States Patent
Stobart et al.

(10) Patent No.: US 10,161,583 B1
(45) Date of Patent: Dec. 25, 2018

(54) LED FLAME EFFECT LIGHTING DEVICE

(71) Applicant: Smart Garden Products Ltd., Abingdon, Oxfordshire (GB)

(72) Inventors: Jonathan Stobart, Longworth (GB); Stuart Glennerster, High Wycombe (GB)

(73) Assignee: Smart Garden Products Ltd., Oxfordshire (GB)

( * ) Notice: Subject to any disclaimer, the term of this patent is extended or adjusted under 35 U.S.C. 154(b) by 0 days.

(21) Appl. No.: 15/708,897

(22) Filed: Sep. 19, 2017

(51) Int. Cl.

| | |
|---|---|
| ***F21V 3/02*** | (2006.01) |
| ***F21S 10/04*** | (2006.01) |
| ***F21V 3/00*** | (2015.01) |
| ***F21V 23/00*** | (2015.01) |
| ***F21S 9/03*** | (2006.01) |
| *F21Y 115/10* | (2016.01) |
| *F21V 17/16* | (2006.01) |

(52) U.S. Cl.
CPC ..... *F21S 10/043* (2013.01); *F21S 9/037* (2013.01); *F21V 3/00* (2013.01); *F21V 23/005* (2013.01); *F21V 17/16* (2013.01); *F21Y 2115/10* (2016.08)

(58) Field of Classification Search
CPC ..... F21S 10/043; F21S 9/037; F21V 3/00; F21V 23/005; F21V 17/16
USPC ..... 362/183
See application file for complete search history.

(56) References Cited

U.S. PATENT DOCUMENTS

| | | | | |
|---|---|---|---|---|
| 5,081,568 | A * | 1/1992 | Dong | F21L 4/02 362/184 |
| 5,924,784 | A * | 7/1999 | Chliwnyj | F21S 9/02 307/64 |
| 7,850,346 | B1 * | 12/2010 | Lauer | F21S 10/04 362/272 |
| 8,408,746 | B1 * | 4/2013 | Lauer | F21S 8/065 362/271 |
| 9,080,736 | B1 * | 7/2015 | Salzinger | H05B 37/0218 |
| 2003/0072154 | A1 * | 4/2003 | Moore | F21S 10/04 362/234 |
| 2004/0223326 | A1 * | 11/2004 | Wainwright | F21S 6/001 362/231 |
| 2007/0139949 | A1 | 6/2007 | Tanda et al. | 362/551 |
| 2011/0063833 | A1 | 3/2011 | Chou et al. | 362/235 |
| 2012/0201022 | A1 | 8/2012 | van de Ven et al. | 115/10 |
| 2013/0070446 | A1 * | 3/2013 | Chen | F21L 4/02 362/183 |
| 2015/0043227 | A1 * | 2/2015 | Yang | F21V 19/0025 362/382 |
| 2016/0057829 | A1 | 2/2016 | Li | 33/827 |
| 2017/0191632 | A1 * | 7/2017 | Li | F21S 10/043 |

(Continued)

FOREIGN PATENT DOCUMENTS

| | | | |
|---|---|---|---|
| CN | 206001393 | 8/2017 | F21K 9/23 |
| GB | 2527606 | 12/2015 | |

OTHER PUBLICATIONS

International Search Report for EP 18178195.2 dated Sep. 2018.

*Primary Examiner* — Claude J Brown

(74) *Attorney, Agent, or Firm* — MacCord Mason PLLC

(57) ABSTRACT

There is provided a lighting device comprising a plurality of light emitting diodes (LEDs) that simulate a flame. The device comprises a circuit board having a plurality of through-holes extending between two opposing faces of the circuit board, and wherein at least some of the LEDs are mounted inside the through-holes so they are visible from both faces of the circuit board.

13 Claims, 2 Drawing Sheets

(56) References Cited

U.S. PATENT DOCUMENTS

Figure 1:
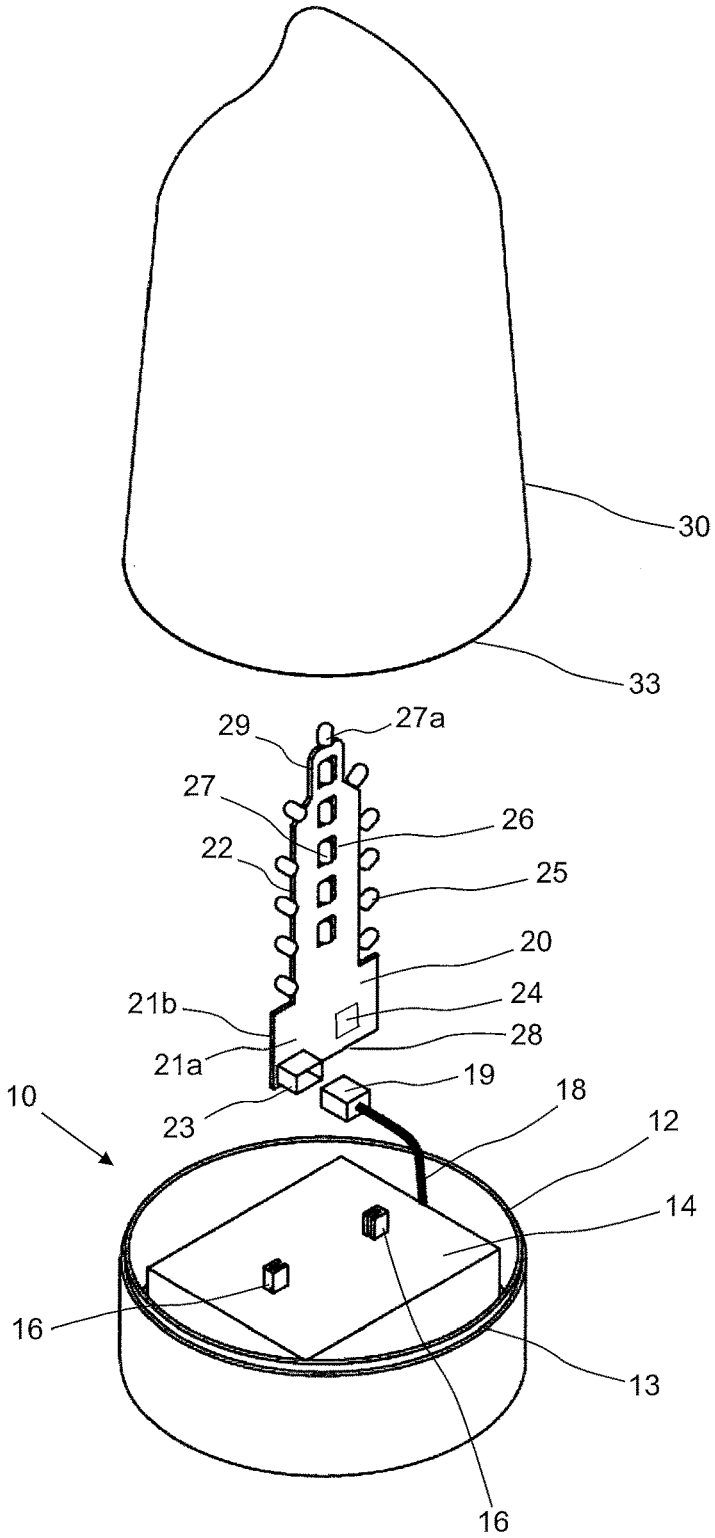

| | | | | |
|---|---|---|---|---|
| 2018/0066811 | A1* | 3/2018 | Knapp | F21K 9/68 |
| 2018/0163937 | A1* | 6/2018 | Lee | F21S 10/043 |

* cited by examiner

LED FLAME EFFECT LIGHTING DEVICE

This application claims the benefit of GB 1710069.4 filed 23 Jun. 2017.

DESCRIPTION

The present invention relates to a lighting device comprising a plurality of Light Emitting Diodes (LEDs) that simulate a flame; for example, a flaming torch.

BACKGROUND OF THE INVENTION

It is known to produce lighting devices that incorporate LEDs which simulate a flame. For an effective simulation, the lighting device needs to produce a flame-like light which looks like a flame regardless of which direction the lighting device is viewed from.

The German Utility Model DE 202015107152U describes an LED simulation candle where a bottom circuit board is attached horizontally to a base, and three circuit boards with LEDs are vertically soldered to the bottom circuit board at 120 degrees to one another so the flame effect can be seen from any direction.

However, this construction is complex and requires manufacture of multiple circuit boards in order to provide a flame effect that can be seen from all viewing angles.

It is therefore an object of the invention to improve upon known LED simulation flames.

SUMMARY OF THE INVENTION

According to the invention, there is provided a lighting device comprising a plurality of LEDs that simulate a flame. The device comprises a circuit board having a plurality of through-holes extending between two opposing faces of the circuit board, and at least some of the LEDs are mounted inside the through holes so they are visible from faces of the circuit board.

By mounting the LEDs in through-holes, or in other words holes that go all the way through the circuit board, the LEDs become visible on both sides (faces) of the circuit board, without needing to provide multiple circuit boards.

Preferably, a diffusion envelope is mounted on an end cap of the lighting device, and envelops the circuit board so that it diffuses light from the LEDs. Then, the LEDs do not look like point sources of light from outside the envelope and the flame effect is created more effectively.

The plurality of through-holes preferably comprise a line of at least three through-holes in which LEDs are mounted along an axis of symmetry of the circuit board, for example along a central vertical axis of the circuit board, so that the center of the flame is well defined.

An LED driver for powering the LEDs may be mounted on the same circuit board as the LEDs to avoid the need for any additional circuit boards, further reducing the cost of manufacturing the lighting device. The LED driver preferably switches or modulates the powers sent to the LEDs to simulate a flickering flame, for example a candle flame. The plurality of LEDs may comprise at least two groups of LEDs, and the LED driver may switch or modulate the powers sent to the groups of LEDs to light the groups of LEDs at different times to one another.

To help improve the flame effect when the circuit board is viewed from a peripheral side edge of the circuit board, some of the LEDs may be mounted at the peripheral side, and so are visible from the peripheral side and from both faces of the circuit board. The two opposing faces may each be in the shape of a flame, wherein the peripheral side extends all around the flame shape. The LEDs mounted to the peripheral side are preferably spaced around at least 180 degrees of the circuit board periphery, so the flame shape can be discerned when the LEDs are lit. The flame shape may be a candle flame shape, and a candle flame shape is generally understood to be a roughly rectangular shape with a height at least twice its width and optionally narrowed towards the top of the candle flame shape.

DETAILED DESCRIPTION

Figure 2:
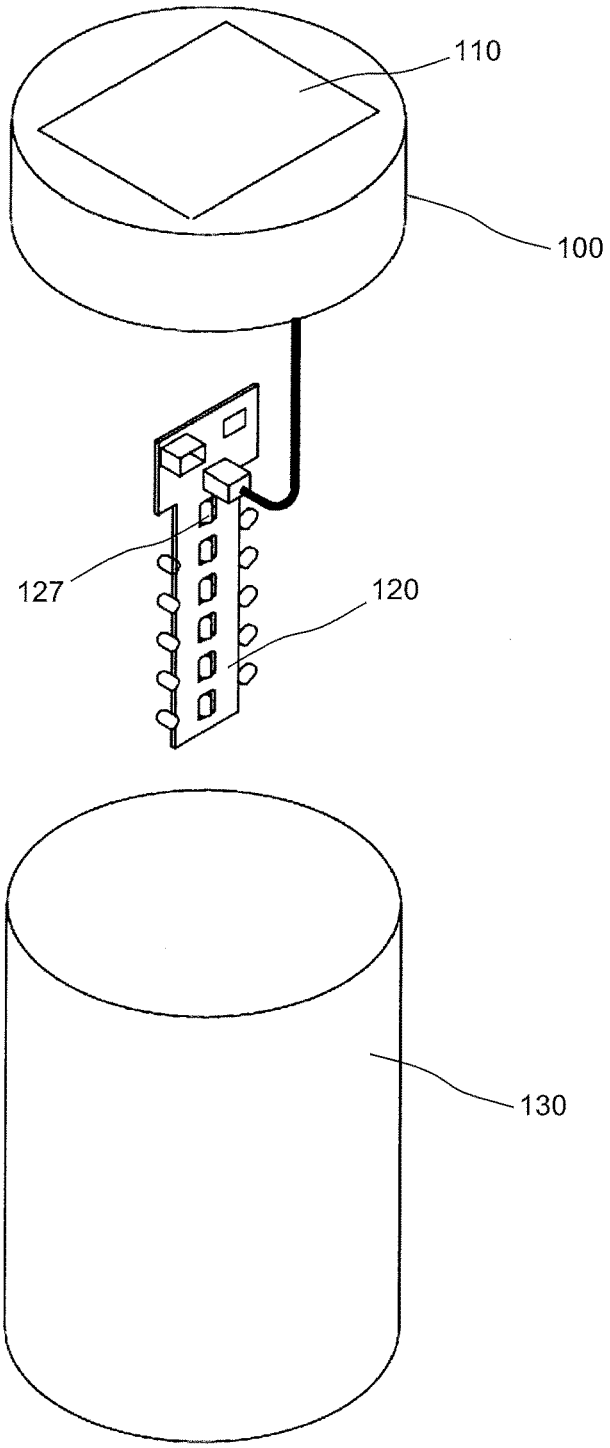

Embodiments of the invention will now be described by way of non-limiting example only and with reference to the accompanying drawings, in which:

FIG. 1 shows an exploded schematic perspective diagram of a lighting device according to a first embodiment of the invention; and FIG. 2 shows an exploded schematic perspective diagram of a lighting device according to a second embodiment of the invention.

The lighting device of the first embodiment has an end cap in the form of a base 10 comprising a circular outer housing 12 and an inner platform 14 inside the housing 12. The base also comprises a power supply cable 18, which terminates in a plug 19. The power supply cable 18 is connected to a battery (not shown) inside the platform 14. Optionally, the battery may be rechargeable, and if so then the base 10 may have a charging jack for receiving electrical power to recharge the battery. Alternatively, the battery could be omitted entirely, and the power supply cable may be connected to a jack socket in the base for receiving electrical power from an external source.

The lighting device also comprises a circuit board 20, which is in the shape of a candle flame. The circuit board shape is roughly rectangular with a height greater than twice its width, and the width of the rectangular shape is narrowed at the top 29 of the circuit board. In this embodiment, the circuit board is a printed circuit board (PCB).

The circuit board 20 has first and second faces 21*a* and 21*b*, which are opposite to one another, and in parallel, separated by the thickness of the circuit board. The circuit board has a peripheral side 22 extending all the way around the circuit board and adjoining from the first face to the second face.

The first face 21*a* has a socket 23 for receiving the plug 19 of the power supply from the base. The circuit board includes conductive tracks (not shown for clarity) that carry the power from the socket 23 to an LED driver 24 on the first face 21*a*.

The circuit board 20 also has five through-holes 26 which extend all the way through the thickness of the circuit board and its faces. The through-holes 26 are arranged centrally along the circuit board in a vertical line, and each one of the through-holes has a single corresponding LED 27 inside of it. The LEDs 27 are electrically connected to the LED driver 24 via conductive tracks (not shown for clarity) of the circuit board 20. The LEDs 27 are visible from both faces 21*a* and 21*b* of the circuit board, via the through-holes 26.

The circuit board 20 also has eleven LEDs 25 spaced apart from one another around the peripheral side 22. The LEDs 25 are also electrically connected to the LED driver 24 via conductive tracks (not shown for clarity) of the circuit board 20. The LEDs 25 are also visible from both faces 21*a* and 21*b* of the circuit board, since they extend beyond the peripheral edge 22, and so are not obscured from view by the circuit board 20. The LEDs 25 and 27 together form a flame shape when they are lit, and the flame shape can be seen from substantially all viewing angles.

The inner platform 14 of the base has two clips 16, and a lower part 28 of the peripheral side 22 of the circuit board fits into the clips 16 to retain the circuit board 20 to the base 10.

The circular outer housing 12 has a stepped portion 13 running around the upper circumference of the housing 12, and a bottom edge 33 of a diffuser 30 is a friction fit over the top edge of the outer housing 12, and rests on the stepped portion 13. The diffuser 30 envelopes the circuit board 20 inside the diffuser, and light from the LEDs is diffused by the diffuser so that the LEDs do not look like point sources of light when viewed from outside the diffuser.

In use, the LED driver 24 sends power to the LEDs 25, 27 to light them and so to simulate a flame. The LEDs are split into groups and the LED driver switches the various groups of LEDs on and off at differing times to one another to simulate a flickering flame torch or candle. Optionally, a Universal Serial Bus (USB) jack could be provided on the base 10 to provide power and/or control, for example to specify how the LED lights should be controlled by the LED driver. The USB jack may power the power supply cable 18 directly, or the USB jack may be used to recharge a battery for powering the power supply cable 18.

The lighting device of the second embodiment shown in FIG. 2 has an end cap in the form of a top 100. The top 100 is substantially the same as the base 10 of the first embodiment, except for that it further includes a solar panel 110 on its top surface. In the second embodiment, the solar panel 110 is used to recharge the battery inside the platform of the top 100.

A circuit board 120, which is similar to the circuit board 20 of the first embodiment, is held by the top 100 using clips on a platform of the top 100, in the same manner as the clips 16 of the platform 14 hold the circuit board 20 of the first embodiment. The circuit board 120 differs from the circuit board 20 in that the circuit board 120 has the LED's arranged the opposite way up compared to the circuit board 20, so that the flame still appears the right way up even although the circuit board orientation is inverted in the second embodiment. For example, the LED 127 adjacent the socket and LED driver of the circuit board simulates the tip of the flame in the second embodiment, whereas the LED 27*a* at an opposite end of the circuit board from the socket and LED driver simulates the tip of the flame in the first embodiment.

A diffuser 130 connects to the top 100 and envelopes the circuit board 120 within it, similar to the diffuser 30 of the first embodiment.

Many other variations of the described embodiments falling within the scope of the appended claims will be apparent to those skilled in the art.

The invention claimed is:

1. A lighting device comprising a plurality of Light Emitting Diodes, LEDs, that simulate a flame, wherein the device comprises a circuit board having a plurality of through-holes extending between two opposing faces of the circuit board, wherein:

some of the LEDs are mounted inside the through holes so they are visible from both faces of the circuit board the circuit board comprises a peripheral side extending between the two opposing faces, and some of the LEDs are mounted at the peripheral side and so are visible from both faces of the circuit board, the peripheral side extends at least 180 degrees around the two opposing faces of the circuit board with the LEDs mounted on opposite peripheral sides of the circuit board to one another, the LEDs mounted inside the through holes are in between the LEDs mounted on the opposite peripheral sides of the circuit board to one another, the device comprises an LED driver that is configured to power the plurality of LEDs, the plurality of LEDs comprise at least two groups of LEDs, and the LED driver is configured to switch or modulate the powers sent to the groups of LEDs at differing times to one another to simulate a flickering flame.

2. The lighting device of claim 1, further comprising an end cap upon which the circuit board is mounted.

3. The lighting device of claim 2, wherein the two opposing faces of the circuit board are orientated vertically when a bottom of the end cap is placed on a horizontal surface.

4. The lighting device of claim 2, further comprising a diffusion envelope which is mounted on the end cap, envelops the circuit board, and diffuses light from the LEDs.

5. The lighting device of claim 2, wherein the end cap comprises a power supply to which the circuit board is electrically connected.

6. The lighting device of claim 5, wherein the end cap comprises a solar panel for powering the power supply.

7. The lighting device of claim 5, wherein the power supply is electrically connected to the LED driver.

8. The lighting device of claim 7, wherein the LED driver is mounted on the circuit board.

9. The lighting device of claim 1, wherein the two opposing faces are each in the shape of a candle flame, the shape being roughly rectangular with a height of twice a width of the shape, and the shape being narrowed towards a top of the shape, wherein the peripheral side extends all around the shape.

10. The lighting device of claim 9, wherein the LEDs mounted to the peripheral side are spaced around at least 180 degrees of the shape.

11. The lighting device of claim 1, wherein the plurality of through-holes comprise a line of at least three through-holes in which LEDs are mounted along an axis of symmetry of the circuit board.

12. The lighting device of claim 1, wherein the circuit board comprises conductive tracks that carry electrical current to and from the LEDs.

13. The lighting device of claim 12, wherein the circuit board is a printed circuit board.

* * * * *